United States Patent [19]

Motsenbocker

[11] 4,265,075

[45] May 5, 1981

[54] SADDLE

[76] Inventor: Don M. Motsenbocker, Rte. 2, Box 35, Wylie, Tex. 75098

[21] Appl. No.: 59,099

[22] Filed: Jul. 19, 1979

[51] Int. Cl.[3] ..... B68C 1/00

[52] U.S. Cl. ..... 54/44

[58] Field of Search ..... 54/37, 38, 39, 42, 44, 54/45

[56] References Cited

U.S. PATENT DOCUMENTS

| | | | |
|---|---|---|---|
| 5,872 | 10/1848 | Calwell | 54/44 |
| 3,323,286 | 6/1967 | Le Laurin, Jr. | 54/44 |
| 3,529,402 | 9/1970 | Queen | 54/44 |
| 3,835,621 | 9/1974 | Gorenschek | 54/44 |

FOREIGN PATENT DOCUMENTS

| | | | |
|---|---|---|---|
| 22885 | 6/1936 | Australia | 54/44 |
| 9110 | of 1888 | United Kingdom | 54/44 |
| 3709 | of 1891 | United Kingdom | 54/44 |

*Primary Examiner*—Gene Mancene
*Assistant Examiner*—Robert P. Swiatek
*Attorney, Agent, or Firm*—Thomas L. Cantrell; Joseph H. Schley

[57] ABSTRACT

Disclosed is an improved saddle comprising a saddle tree which is padded and upholstered on its top. The saddle tree is attached to a padded and flexible saddle skirt by connecting flaps which are affixed to the top of the skirt and which overlie marginal portions of the upholstered tree. Screws or other fasteners are employed to connect the flaps to the upholstered tree. Preferably four flaps are provided, one at each corner of the tree. Cinch rings are mounted on the forward pair of flaps. A stirrup strap is passed through slots in the tree about the middle thereof.

2 Claims, 5 Drawing Figures

SADDLE

BACKGROUND OF THE INVENTION

Saddle building is an ancient art. The typical saddle is built up on a shaped saddle tree, on to which are mounted various layers of leather (or leather substitute), and padding, some of these elements being partly decorative as well as functional, and the whole assembly is attached to a saddle skirt. Depending upon the particular style and materials of construction, such a saddle may weigh between twenty-five and fifty pounds and involve considerable amounts of hand labor in its construction. The latter circumstance makes the typical saddle an expensive item, while the former makes it difficult for slightly-built persons, such as abolescents, to handle, as well as increasing the load on the saddled animal.

SUMMARY OF THE INVENTION

In accordance with the invention, a lightweight and simply constructed saddle is provided. Depending somewhat on the materials employed, the weight of the saddle falls in the range of fourteen pounds.

The primary component of the saddle is a saddle tree, preferably formed of plastic, and padded and upholstered on its top side. The other major component is a flexible padded skirt which underlies the tree and is attached to it. The mode of connection is by connecting flaps which are affixed to the top surface of the skirt, preferably by stitching along their lower margins. The upper portions of the flaps overlie the lower marginal portions of the upholstered tree, and it is prefered that four such flaps be employed, with one being located at each corner of the tree. Connecting means such as screws are employed to connect the flaps to the upholstered tree, thus securing the skirt and tree into a unitary structure. Cinch rings are mounted on the forward pair of flaps, and a stirrup strap is passed through horizontal slots in the tree located approximately midway of its length.

The use of removable connecting means such as screws to connect the tree and skirt together through the flaps is of particular advantage. The skirt tends to become soiled in use more rapidly than the upholstered tree, and it also tends to wear out more rapidly. By the use of removable and for laundering or replacement.

The reduction of the saddle to two major components secured together with connecting flaps as just described produces a saddle which is light in weight, easily handled, and sharp in appearance. It also eliminates much hand labor in the construction of the saddle, as well as reducing materials costs.

From the foregoing it can be seen that amoung the objects of the invention are the provision of a lightweight, simple, easily constructed saddle having a readily removable skirt.

The manner in which these objects, together with other objects and purposes, are attained can best be understood by a consideration of the detailed description which follows, together with the accompanying drawings.

DESCRIPTION OF THE PREFERRED EMBODIMENTS

Figure 1:
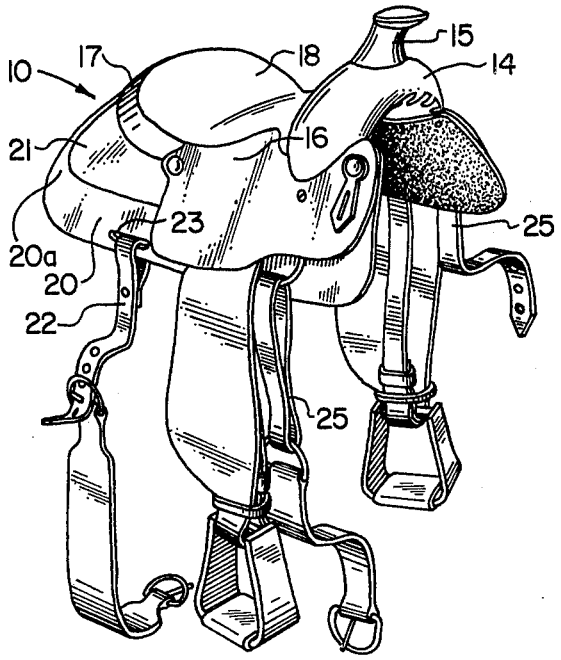
FIG. 1 (PRIOR ART)
FIG. 1 is a perspective view of a typical prior art saddle.
Figure 2:
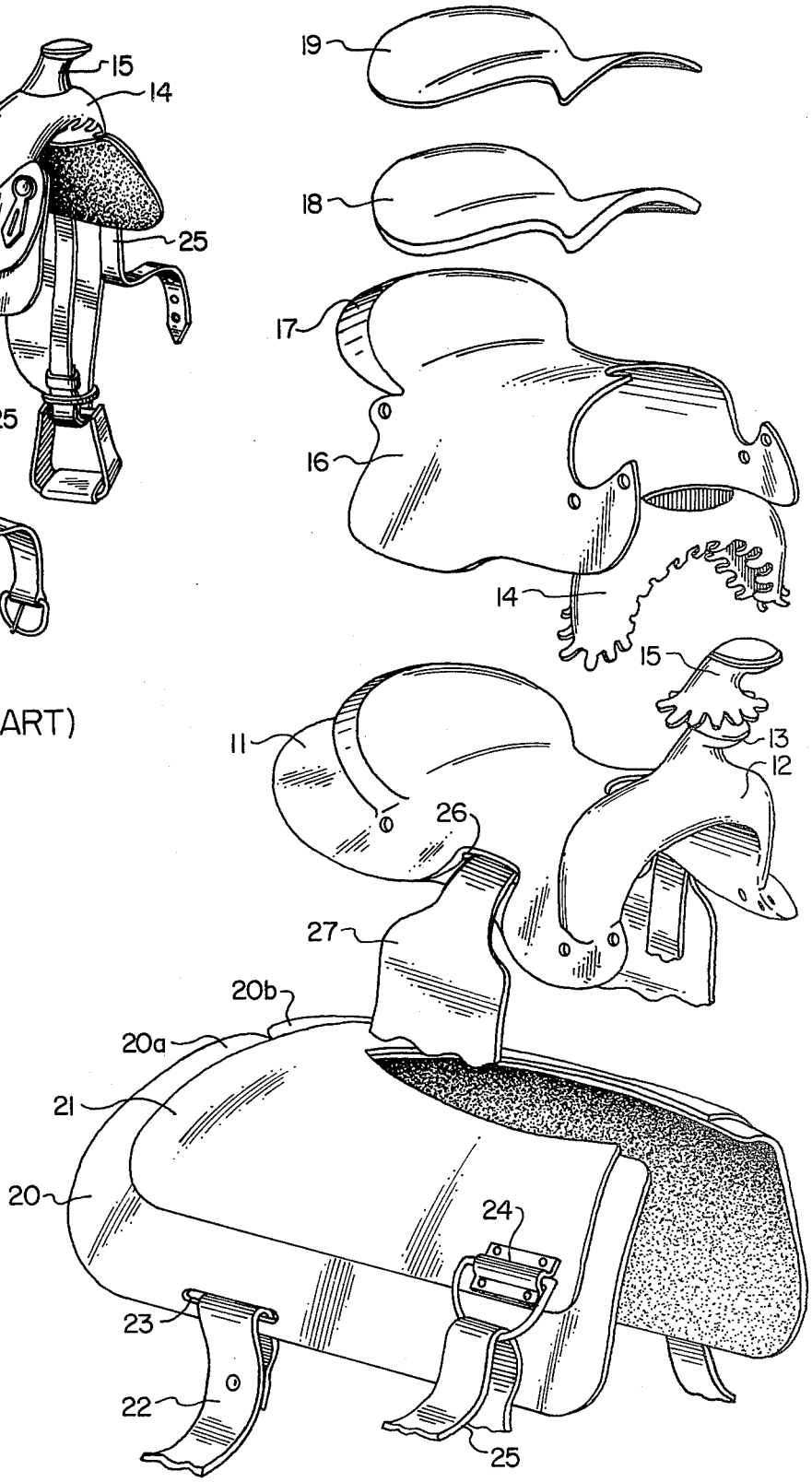
FIG. 2 (PRIOR ART)
FIG. 2 is an exploded perspective view of the prior art saddle of FIG. 1.

The advantages of the present invention can best be appreciated by first considering the complexity of saddle construction as practiced in the art heretofore. Against this background, the simplicity of the invention will become apparent. FIGS. 1 and 2 illustrate a typical saddle of the prior art, and show that it comprises numerous parts which must be fitted together by hand.

In particular, the prior art saddle 10 comprises a saddle tree 11, which is covered by other parts in FIG. 1, but can seen in FIG. 2. The saddle tree 11 includes a swell 12 and horn 13. The swell is provided with a swell cover 14, and the horn with a horn cover 15.

The saddle tree 11 is overlaid with a jockey seat 16, which includes a cantle cover 17 extending over the cantle portion of the tree. Padding 18 is placed over the jockey seat, and is covered with seat upholstery 19.

Beneath the saddle tree are two skirts, one being a two-piece underskirt 20, the pieces of which are designated **20*a* and 20*b*, and a one piece overskirt 21. As can best be seen in FIG. 1, part of jockey seat 16 extends down over these skirts. A back cinch 22 is connected to underskirt 20 by means of slots 23 provided therein. Metal ring plates 24 are mounted on overskirt 21 on each side near the front thereof for mounting front cinch 25**.

Tree 11 has a slot 26 formed in each side thereof about midway of its length, and stirrup strap 27 is passed through these slots. The jockey seat 16 extends downwardly over slots 26, a portion of the stirrup strap 27, and the ring plates 24.

The parts of the prior art saddle 10 described above are connected together into a unitary structure by adhesives, stitching, rivets, and/or screws. No attempt has been made to show the modes of attachment in detail in FIGS. 1 and 2, although the heads of some rivets, and rivet holes in tree 11 and jockey seat 16 do appear.

Figure 3:
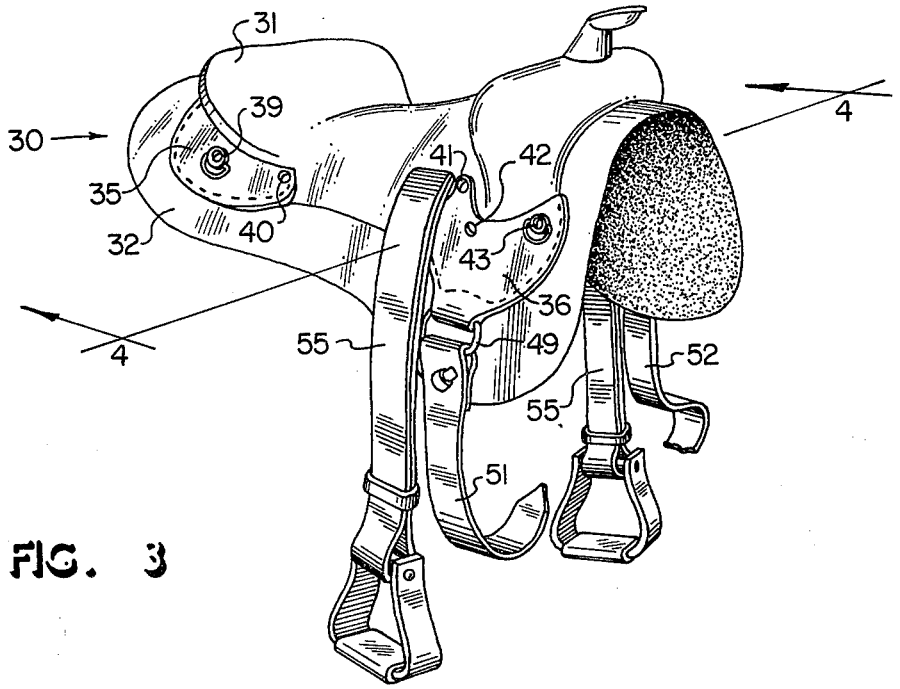
FIG. 3 is a perspective view of a saddle constructed in accordance with the invention.
Figure 4:
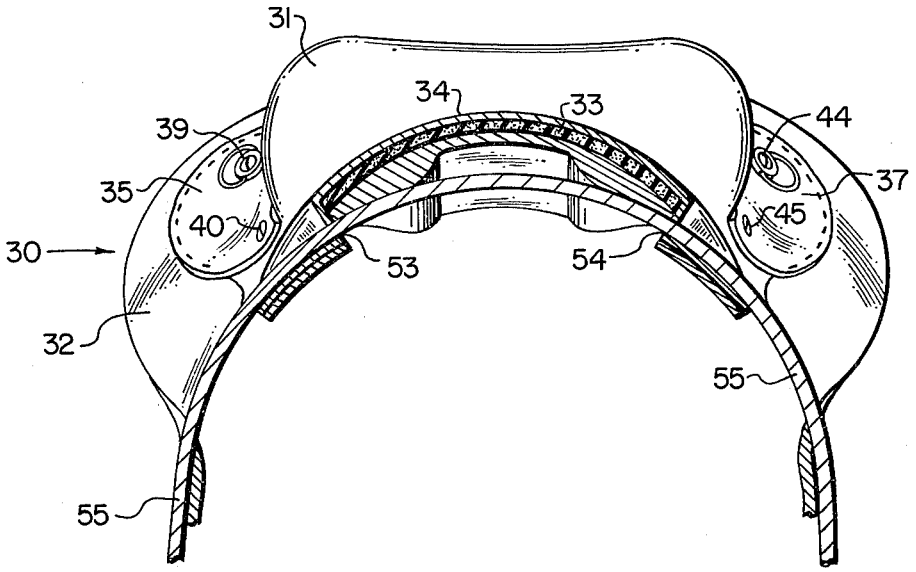
FIG. 4 is a sectional elevational view on an enlarged scale compared to FIG. 3 of the saddle of the invention, the section being taken along the line 4—4 of FIG. 3.
Figure 5:
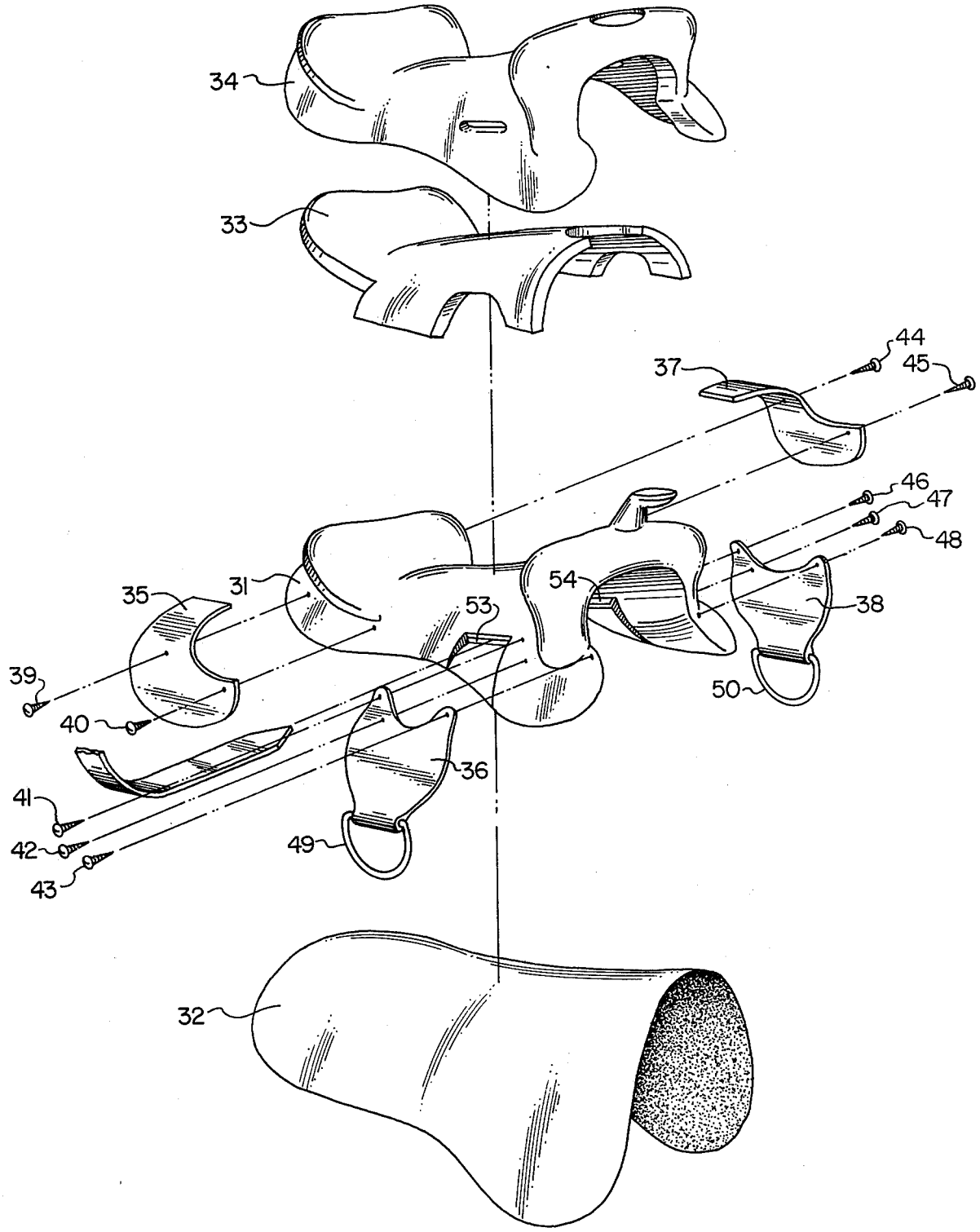
FIG. 5 is an exploded perspective view of the saddle of FIG. 3.

The saddle of the invention is shown in FIGS. 3–5, and it should be noted that FIGS. 3 and 5 are drawn on a somewhat enlarged scale compared to FIGS. 1 and 2, so that the saddle of the invention appears slightly larger than the prior art saddle, whereas in fact it is typically appreciably smaller. FIG. 4, of course, is on a still further enlarged scale.

In FIGS. 3–5, the saddle of the invention is designated generally as 30. It comprises two major components, saddle tree 31, and skirt 32. Padding 33 is positioned on top of the tree, and both the tree and the padding are covered with upholstery 34. The tree, padding, and upholstery are connected together to form a unitary subassembly, termed here an upholstered tree, by adhesives, stitching, staples, or other suitable fasteners.

Skirt 32 is formed of flexible material, such as a textile, and is preferably padded sufficiently to make the use of a separate saddle blanket unnecessary. Four connecting flaps 35, 36, 37 and 38 are attached to the skirt, preferably by stitching. They are preferably positioned at the four corners of tree 31. The flaps are preferably configured and the stitching so arranged that each flap and the adjacent portion of skirt 32 together forms a pocket into which a corner of tree 31 can be fitted.

With the tree positioned on the skirt with its corners fitted into the above described pockets, assembly of the two together is completed by driving screws 39 through 48 through the connecting flaps and into the material of tree 31. Each rear flap is connected with two such screws, while three such screws are employed for each front flap. While other types of connecting means may be employed, screws are preferred because they are both removable and reusable, thus making it possible to replace a worn skirt or remove a skirt for laundering and reattachment to the tree.

Front flaps 36 and 38 are provided with cinch rings 49 and 50; and cinch straps 51, 52 are connected to the rings. Slots 53, 54 are provided in tree 31 about midway of its length, and stirrup strap 55 is passed through them.

From the foregoing it can be seen that the present invention provides a simple, easily constructed lightweight saddle.

I claim:

1. A saddle comprising:

a saddle tree having a seat region on the top thereof and having four corner areas;

padding positioned atop said tree;

a layer of upholstery covering said padding and securing it to said tree;

a padded flexible saddle skirt underlying said saddle tree;

four connecting flaps affixed to said saddle skirt one flap being positioned at each corner area of said tree, a portion of each flap extending over the margins of said tree and upholstery, said connecting flaps being affixed to said skirt along their margins to form with said skirt pockets into which the corner areas of said tree are received;

removable connecting means for said connecting flaps attaching the overlapping portion of said flaps to said tree through said upholstery;

cinch rings mounted on the connecting flaps at the front corners of said saddle tree; and slots in said saddle tree for accepting a stirrup strap therethrough.

2. A saddle in accordance with claim 1 in which said connecting means are screws.

* * * * *